US010502447B2

(12) United States Patent
Branham

(10) Patent No.: US 10,502,447 B2
(45) Date of Patent: Dec. 10, 2019

(54) VENTILATION FAN HOUSING AND MOUNTING SYSTEM

(71) Applicant: ASCENT PRODUCTS, LLC, Gig Harbor, WA (US)

(72) Inventor: Tony J. Branham, Gig Harbor, WA (US)

(73) Assignee: Ascent Products, LLC, Gig Harbor, WA (US)

( * ) Notice: Subject to any disclaimer, the term of this patent is extended or adjusted under 35 U.S.C. 154(b) by 0 days.

(21) Appl. No.: 15/799,078

(22) Filed: Oct. 31, 2017

(65) Prior Publication Data

US 2019/0032953 A1 Jan. 31, 2019

Related U.S. Application Data

(60) Provisional application No. 62/537,314, filed on Jul. 26, 2017.

(51) Int. Cl.

| | |
|---|---|
| ***F24F 7/00*** | (2006.01) |
| ***F24F 13/02*** | (2006.01) |
| ***F24F 13/20*** | (2006.01) |
| ***F24F 13/06*** | (2006.01) |

(52) U.S. Cl.

CPC ..... *F24F 13/0254* (2013.01); *F24F 13/0209* (2013.01); *F24F 13/0236* (2013.01); *F24F 13/06* (2013.01); *F24F 13/20* (2013.01); *F24F 2013/205* (2013.01)

(58) Field of Classification Search

CPC .... F24F 13/0254; F24F 13/0209; F24F 13/06; F24F 2221/14; F21V 33/0096

USPC ..... 454/248, 259, 333

See application file for complete search history.

(56) References Cited

U.S. PATENT DOCUMENTS

| | | | | | |
|---|---|---|---|---|---|
| 2,650,021 | A | | 8/1953 | Morrill | |
| 2,961,115 | A | * | 11/1960 | Aylor | B65D 25/22 217/69 |
| 2,963,783 | A | * | 12/1960 | Field | B21C 37/28 285/183 |
| 4,009,894 | A | * | 3/1977 | Marquette | F16L 41/08 285/183 |
| 4,294,476 | A | * | 10/1981 | Nash | F24F 13/0209 285/189 |
| 4,491,124 | A | * | 1/1985 | Goettel | F16L 37/008 126/293 |
| 4,550,648 | A | * | 11/1985 | Eagle | F24F 13/08 454/260 |
| 4,684,092 | A | | 8/1987 | Reiker | |
| 4,834,615 | A | | 5/1989 | Mauch et al. | |

(Continued)

*Primary Examiner* — Vivek K Shirsat

(74) *Attorney, Agent, or Firm* — Seed Intellectual Property Law Group LLP

(57) ABSTRACT

A fan housing and mounting system, including vent duct connector, that facilitates installation of a fan in a rough opening in a wall or ceiling, the housing having a first tab extending from the distal end of the wall and a second tab extending from the distal end of the wall, the first tab sized and shaped to engage a first side of the wall or ceiling, and the second tab sized and shaped to engage a second side of the structural member adjacent the rough opening to attach the housing to the wall or ceiling. A vent duct connector utilizes a novel notched flange to engage the housing in restricted installation spaces.

18 Claims, 15 Drawing Sheets

(56) References Cited

U.S. PATENT DOCUMENTS 5,044,987 A * 9/1991 Tihanyi ..... H01R 13/74 29/844
5,152,117 A * 10/1992 Wynar ..... E04B 2/7457 52/241
5,211,580 A * 5/1993 Schuplin ..... H01R 13/74 220/3.5
5,314,212 A * 5/1994 Sanders ..... F16L 41/082 285/189
5,393,106 A * 2/1995 Schroeder ..... F16L 41/082 285/136.1
5,518,277 A * 5/1996 Sanders ..... F16L 41/082 285/189
5,520,509 A 5/1996 Zimmerman
5,538,293 A * 7/1996 Kolt ..... F16L 37/008 285/189
5,799,446 A * 9/1998 Tamlyn ..... E04D 13/158 52/302.1
5,906,475 A 5/1999 Melane et al.
5,957,506 A * 9/1999 Stepp ..... F16L 43/00 285/183
6,369,326 B1 4/2002 Rippel et al.
6,488,579 B2 * 12/2002 Larson ..... F24F 7/007 415/204
6,722,971 B2 4/2004 Gough
6,802,770 B2 10/2004 Larson et al.
7,011,578 B1 * 3/2006 Core ..... F24F 7/007 454/292
7,455,500 B2 11/2008 Penlesky et al.
7,530,717 B2 5/2009 Magisano et al.
7,940,525 B2 5/2011 Létourneau
7,987,649 B1 * 8/2011 Polston ..... E04D 13/152 454/260
8,486,525 B2 * 7/2013 Segur ..... C09J 7/0207 277/312
8,985,364 B2 * 3/2015 Gagne ..... H02G 3/36 220/3.3
9,222,266 B1 * 12/2015 Conboy ..... E04F 13/06
9,591,390 B2 3/2017 Humphreys et al.
9,689,581 B2 6/2017 Zakula et al.
9,845,968 B2 * 12/2017 Couto ..... F24F 13/084
2008/0318515 A1 * 12/2008 Yeung ..... F04D 29/4206 454/354
2009/0186572 A1 * 7/2009 Farrell ..... F24F 13/06 454/256
2013/0130612 A1 5/2013 Penlesky et al.
2015/0219118 A1 8/2015 Zakula et al.

* cited by examiner

VENTILATION FAN HOUSING AND MOUNTING SYSTEM

BACKGROUND

Technical Field

The present disclosure pertains to the mounting of objects within a structural member, such as a wall, ceiling, and the like and, more particularly, to a ceiling or wall exhaust fan housing and mounting apparatus employing bendable tabs for removable attachment to the structural member without the use of tools and a vent duct connector with a slidable connection assembly to facilitate reduced height and room-side installation.

Description of the Related Art

Installation of objects, such as fans, light fixtures, controls, and the like in the interior of a residence or business can be complex and time consuming. In addition to the task of forming the correct opening, the installer must adequately fasten the object to the structural support. This requires the use of the correct fasteners, tools, and proper technique, and it typically requires access to the back side of the surface, such as via an attic for ceiling mount locations. It is desirable to provide a housing and mounting system that enables the installer to mount the housing from the interior of the room or space and thus avoid having the installer access the back side of the structural member, such as entering an attic or crawl space to install the housing. It is also desirable to provide for mounting to the structural member without the use of fasteners or tools, and to facilitate connection to existing or new ducting within a constrained space.

BRIEF SUMMARY

The present disclosure is directed to a fan housing and mounting system, including vent duct connector, that facilitates installation of an object, such as a ventilation or exhaust fan, in a rough opening in a structural member, for example a wall or ceiling. In accordance with one implementation of the present disclosure, a housing is provided that includes at least one wall circumscribing an interior space that is sized and shaped to accommodate the object. The at least one wall has a distal end, a first tab extending from the distal end, and a second tab extending from the distal end, the first tab sized and shaped to engage a first side of the structural member to retain the housing in the rough opening of the structural member, and the second tab sized and shaped to engage a second side of the structural member adjacent the rough opening and attach the housing to the structural surface.

In accordance with another aspect of the present disclosure, the first and second tabs are integrally formed with the at least one wall are co-planar with the at least one wall, the first and second tabs formed of bendable material that retains a bent shape and can be bent back to an original position, the first and second tabs having a thickness that enables manual bending of the first and second tabs from the original position to at least an angle of 90 degrees with respect to the at least one wall.

In accordance with a further aspect of the present disclosure, the first and second tabs are capable of being bent more than once without breaking. Ideally, the first and second tabs are formed of a material and of a thickness that facilitates manual bending of the tabs by hand and without requiring tools yet remaining in place under load.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with the use of fans, ducting, panels, walls, ceilings, and doors, as well as framing for walls, ceilings, doors, and the like, and installation processes for ceiling and wall fans have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

Figure 1:
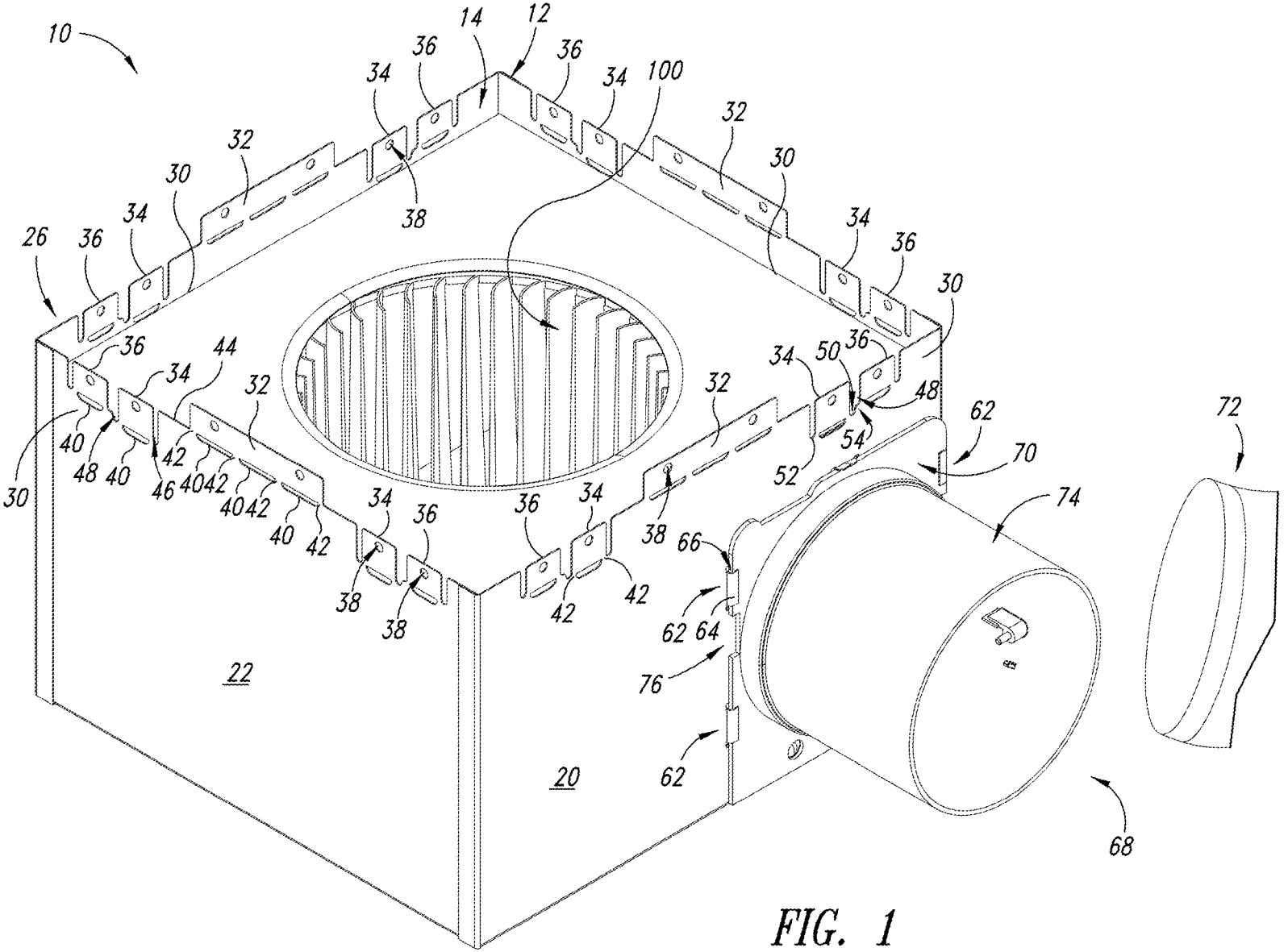
FIG. 1 is a bottom, right, front axonometric view of a fan housing formed in accordance with the present disclosure.
Figure 2:
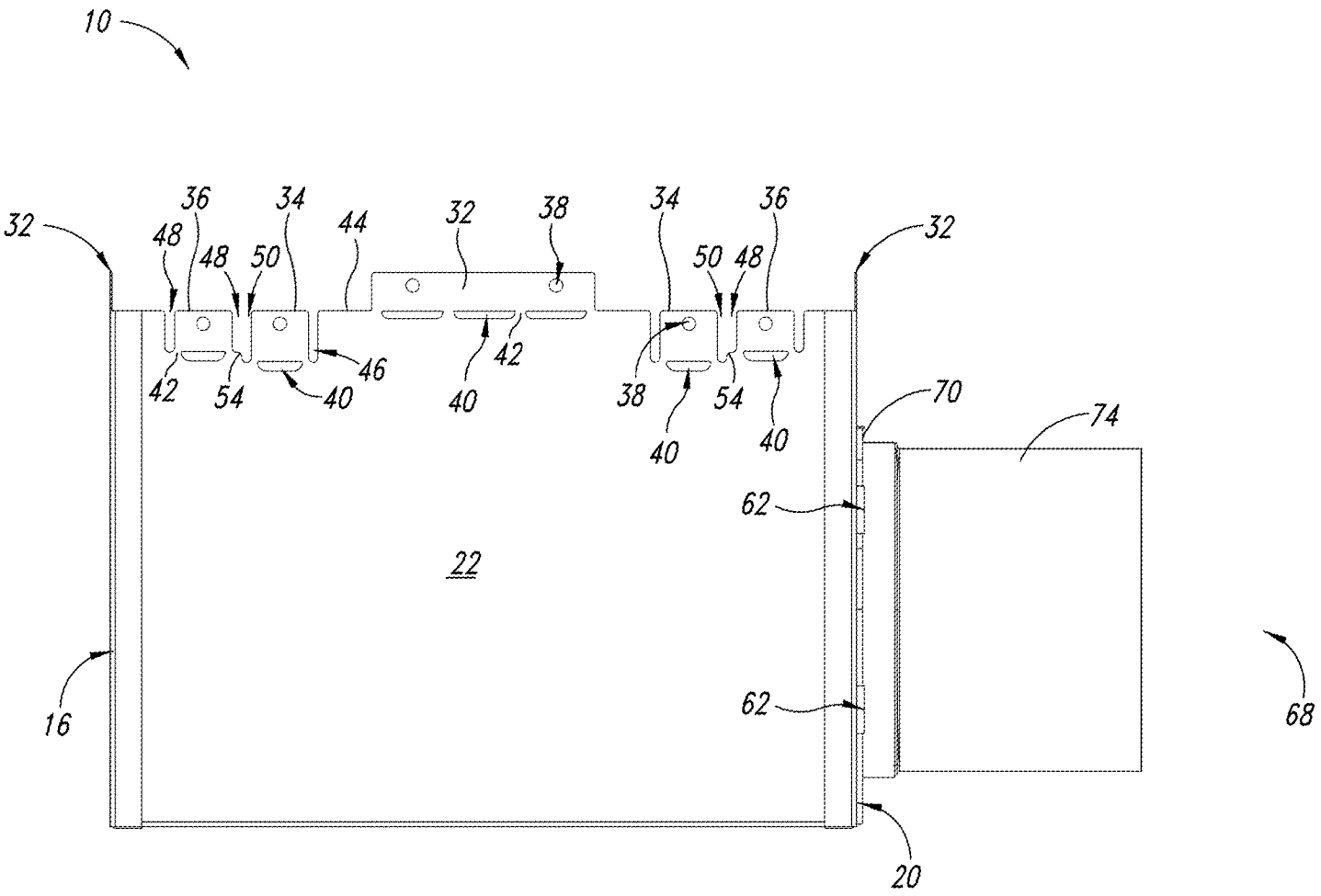
FIG. 2 is a right side elevational view thereof.
Figure 3:
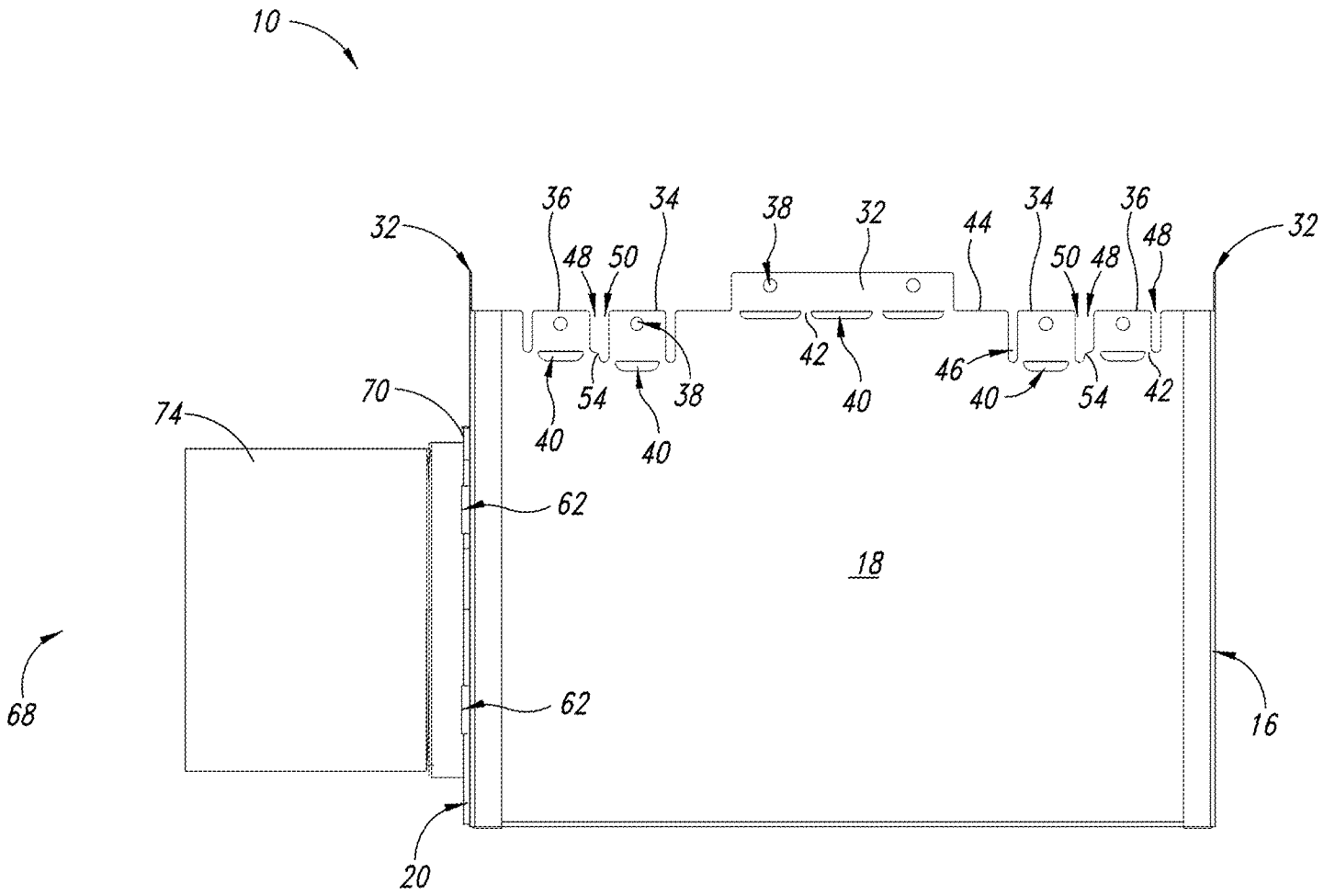
FIG. 3 is a left side elevational view thereof.
Figure 4:
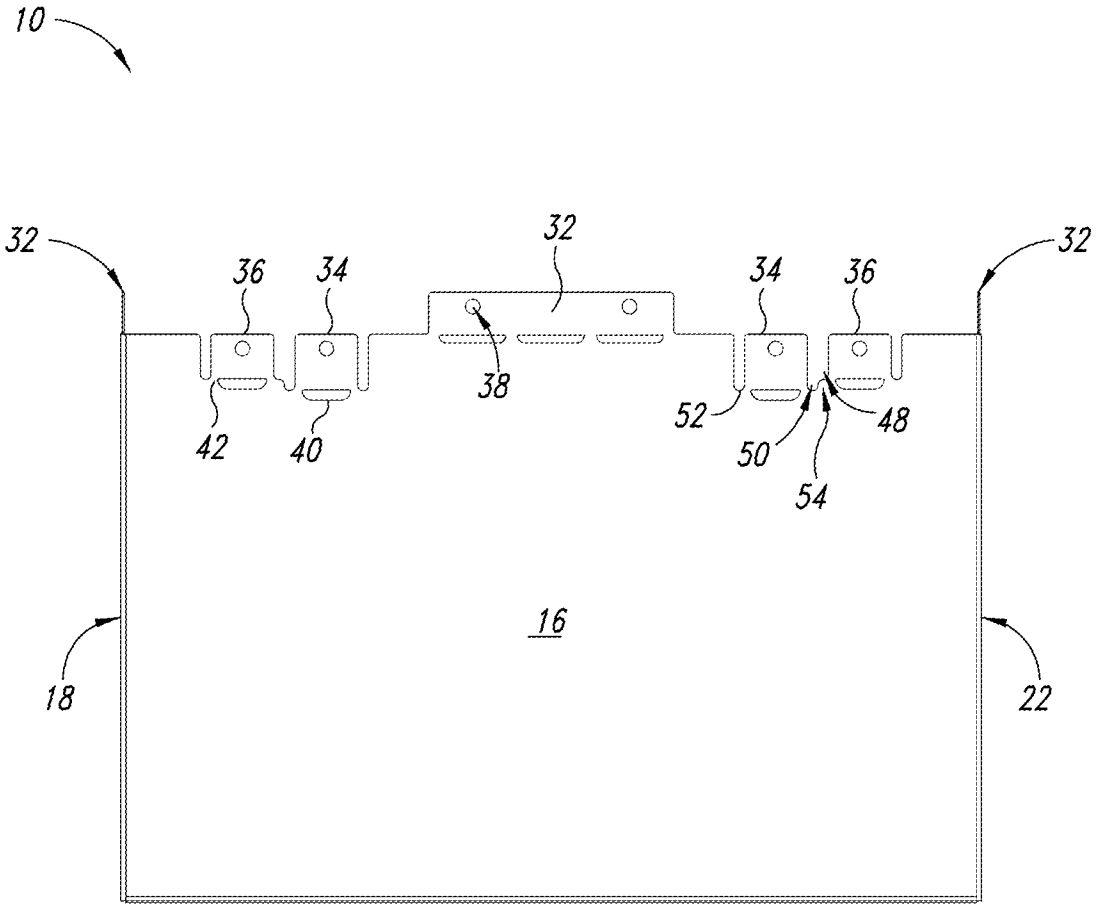
FIG. 4 is a rear elevational view thereof.
Figure 5:
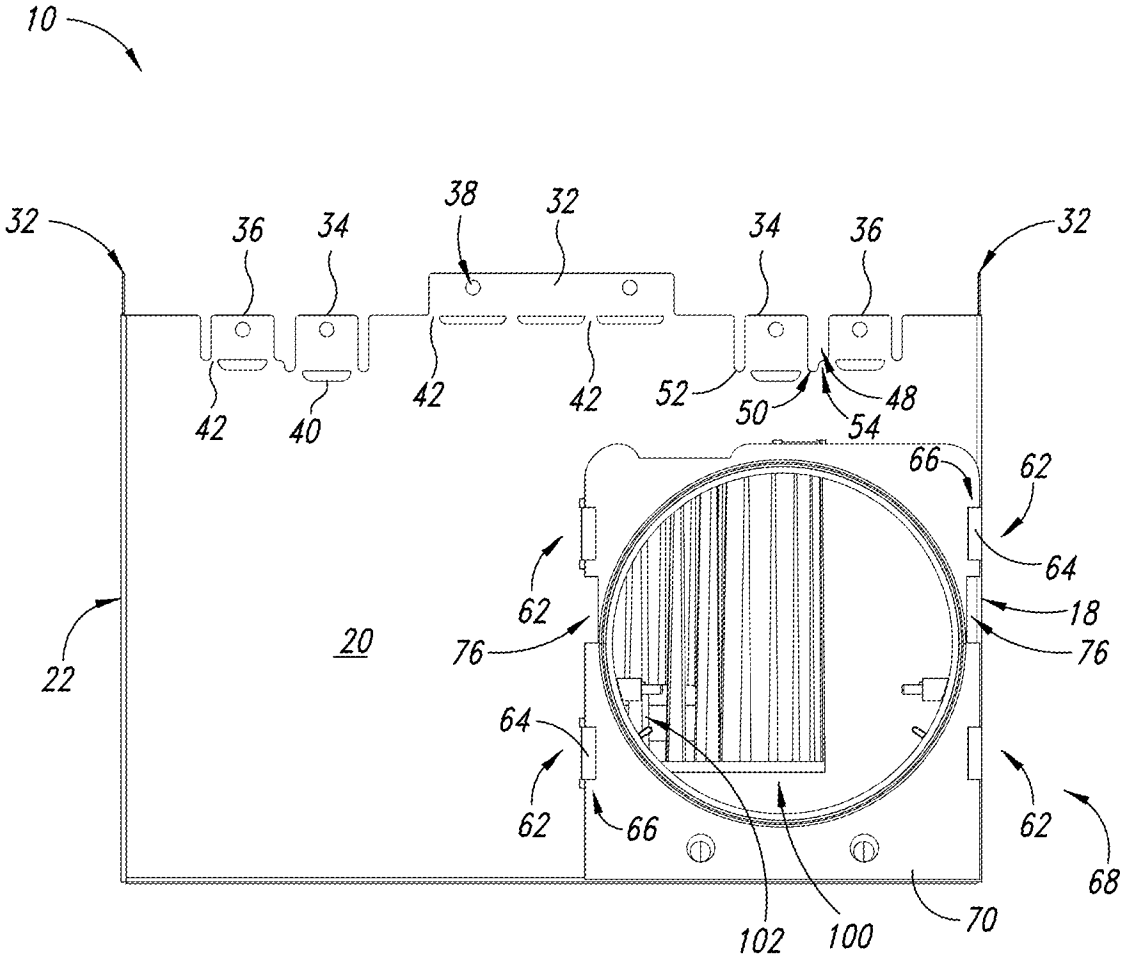
FIG. 5 is a front elevational view thereof.
Figure 6:
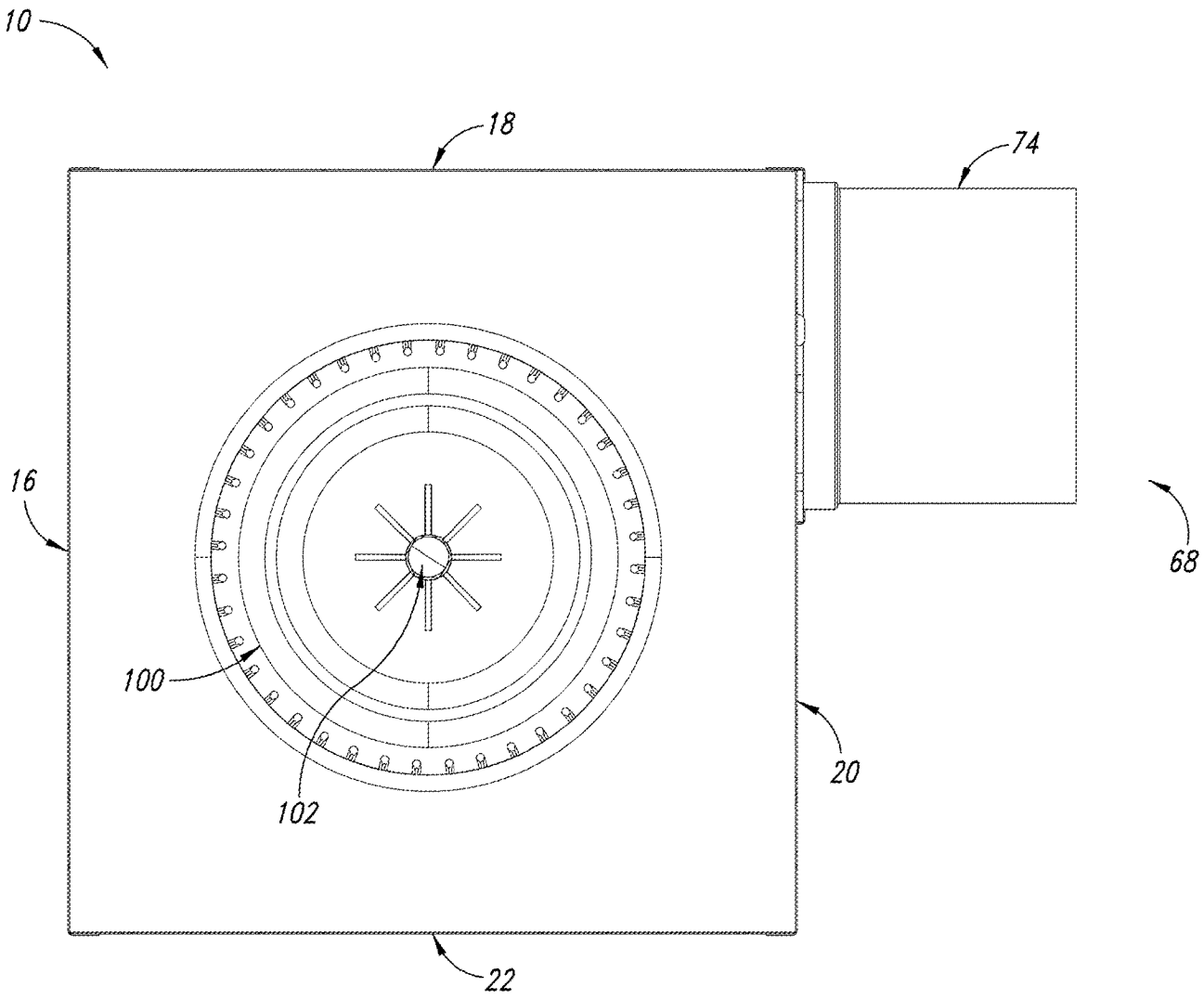
FIG. 6 is a bottom plan view thereof.
Figure 7:
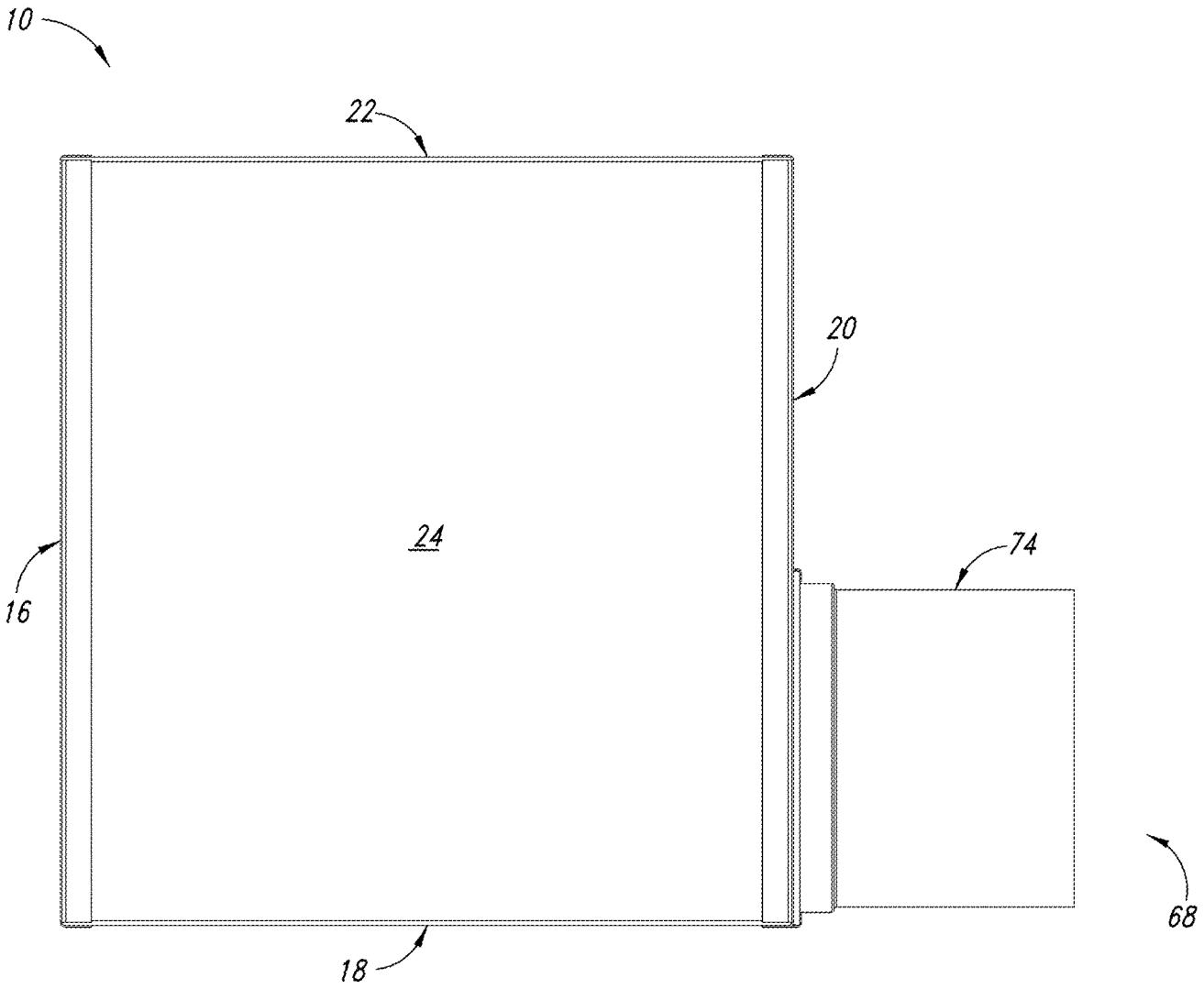
FIG. 7 is a top plan view thereof.
Figure 8A:
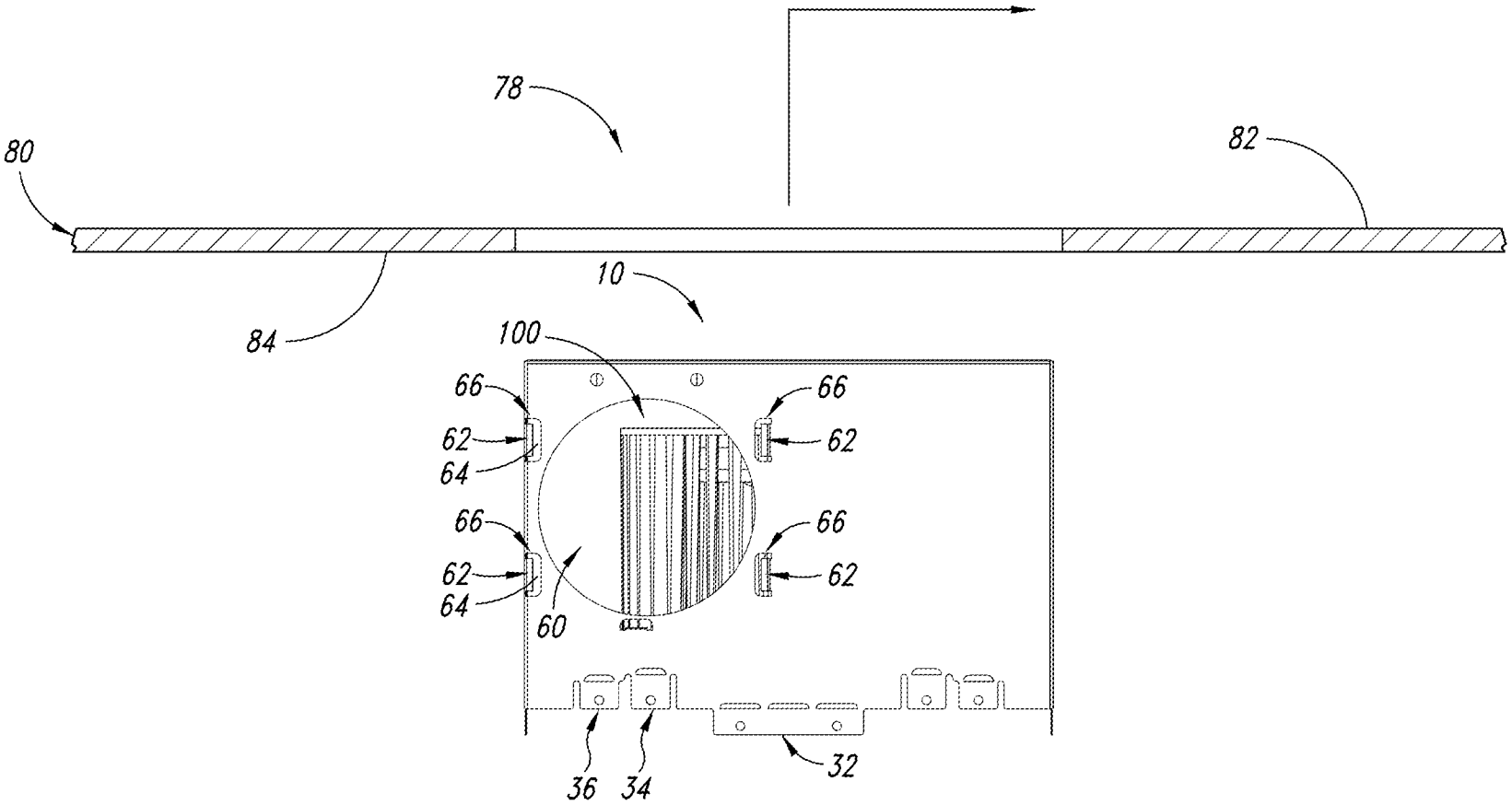
FIG. 8A is a partial cross-sectional front view of the housing below a rough opening prior to installation.
Figure 8B:
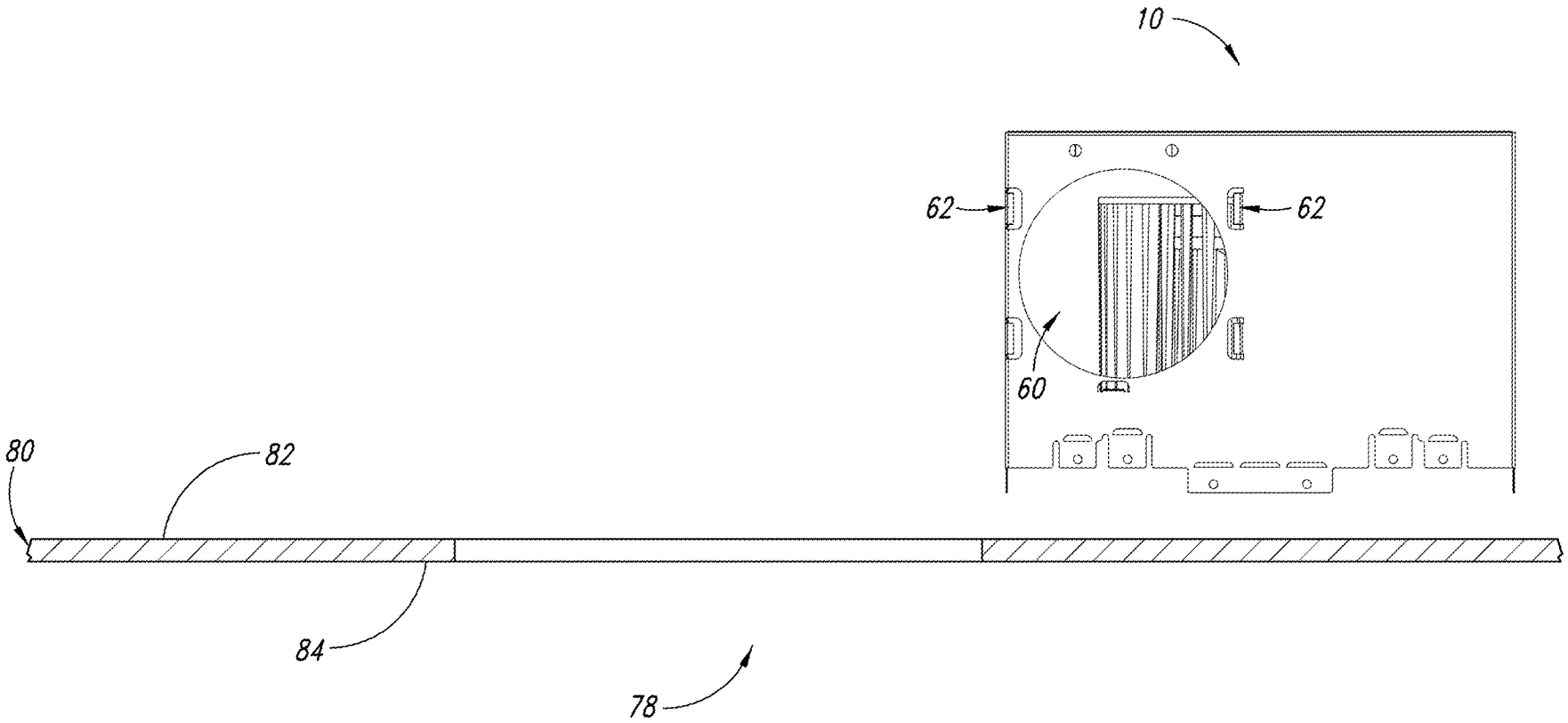
FIG. 8B is a partial cross-sectional front view of the housing inserted through the rough opening and positioned above the ceiling to the side of the rough opening.
Figure 9A:
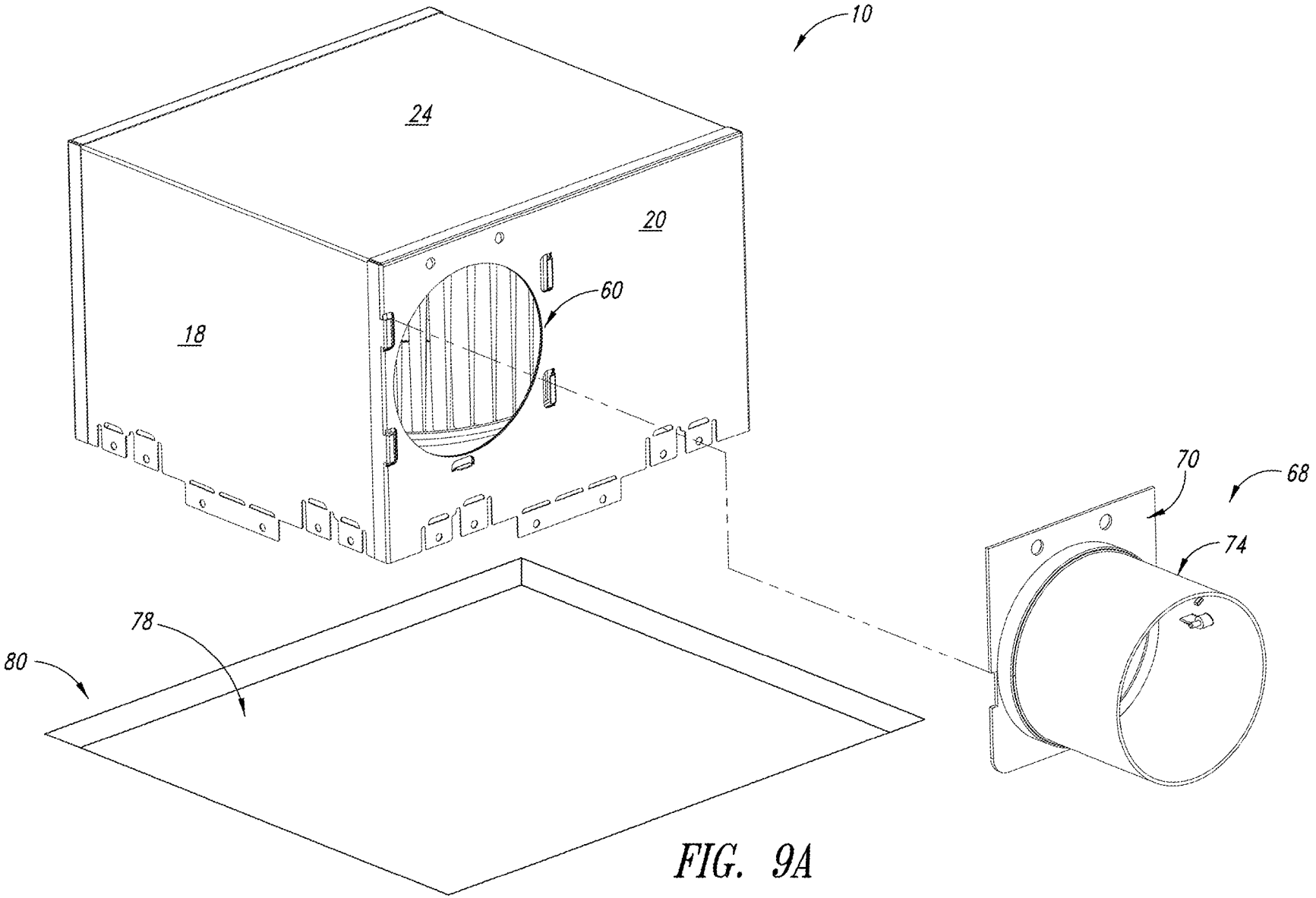
FIG. 9A illustrates the housing positioned above the rough opening with the vent duct connector in exploded view.
Figure 9B:
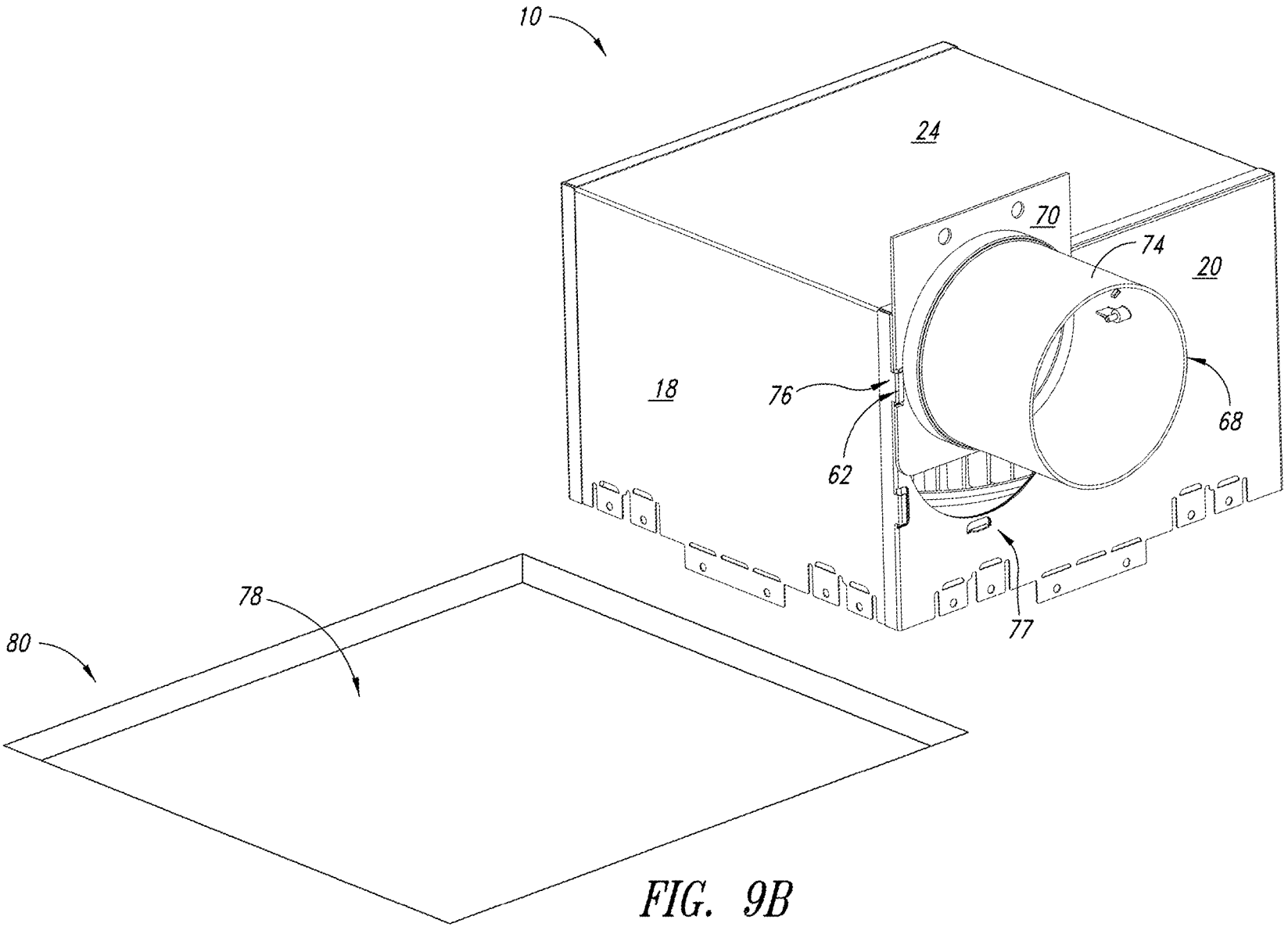
FIG. 9B illustrates the vent duct connector in an initial orientation against the housing.
Figure 9C:
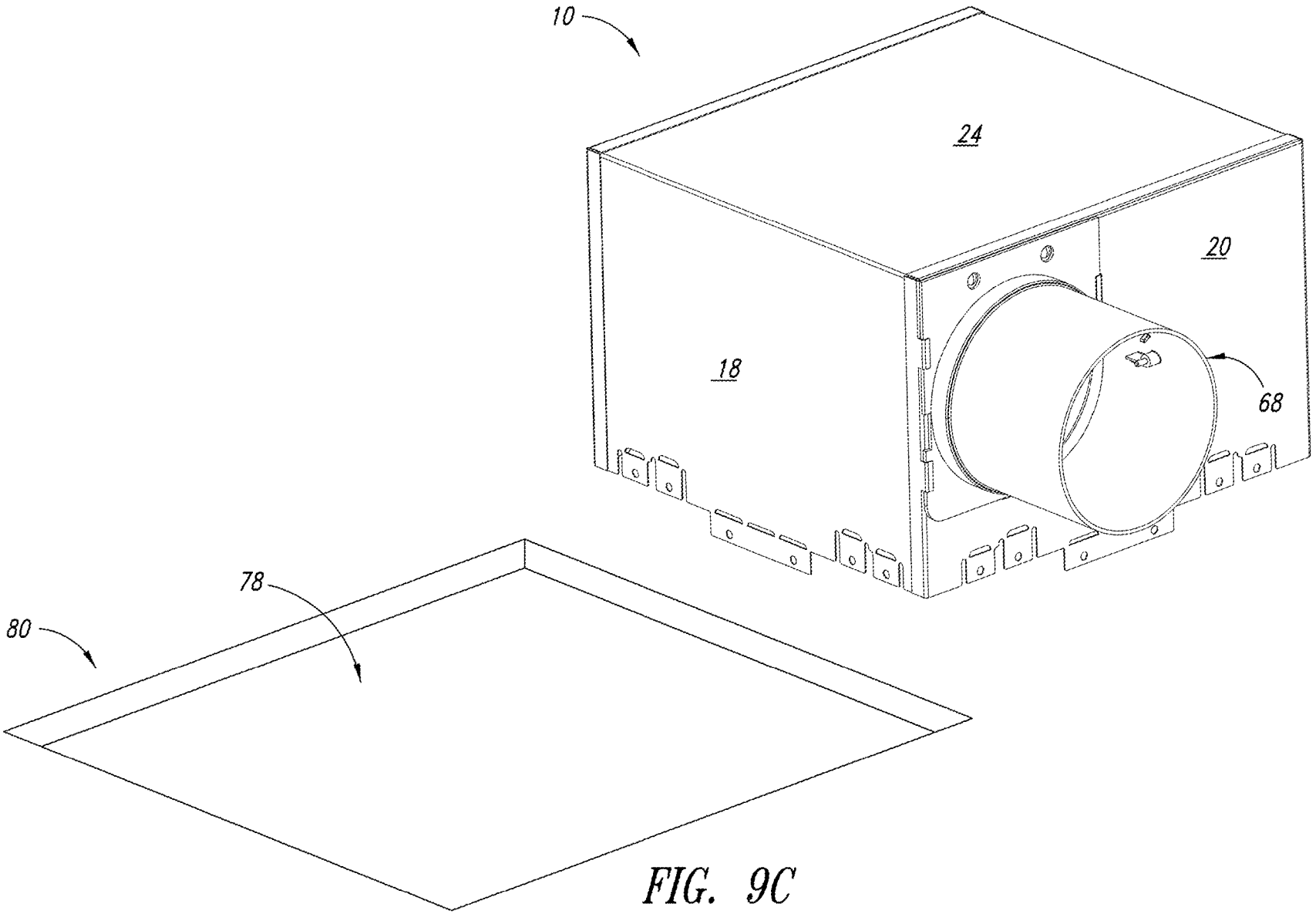
FIG. 9C shows the vent duct connector slid down the tracks into an installed position.
Figure 10A:
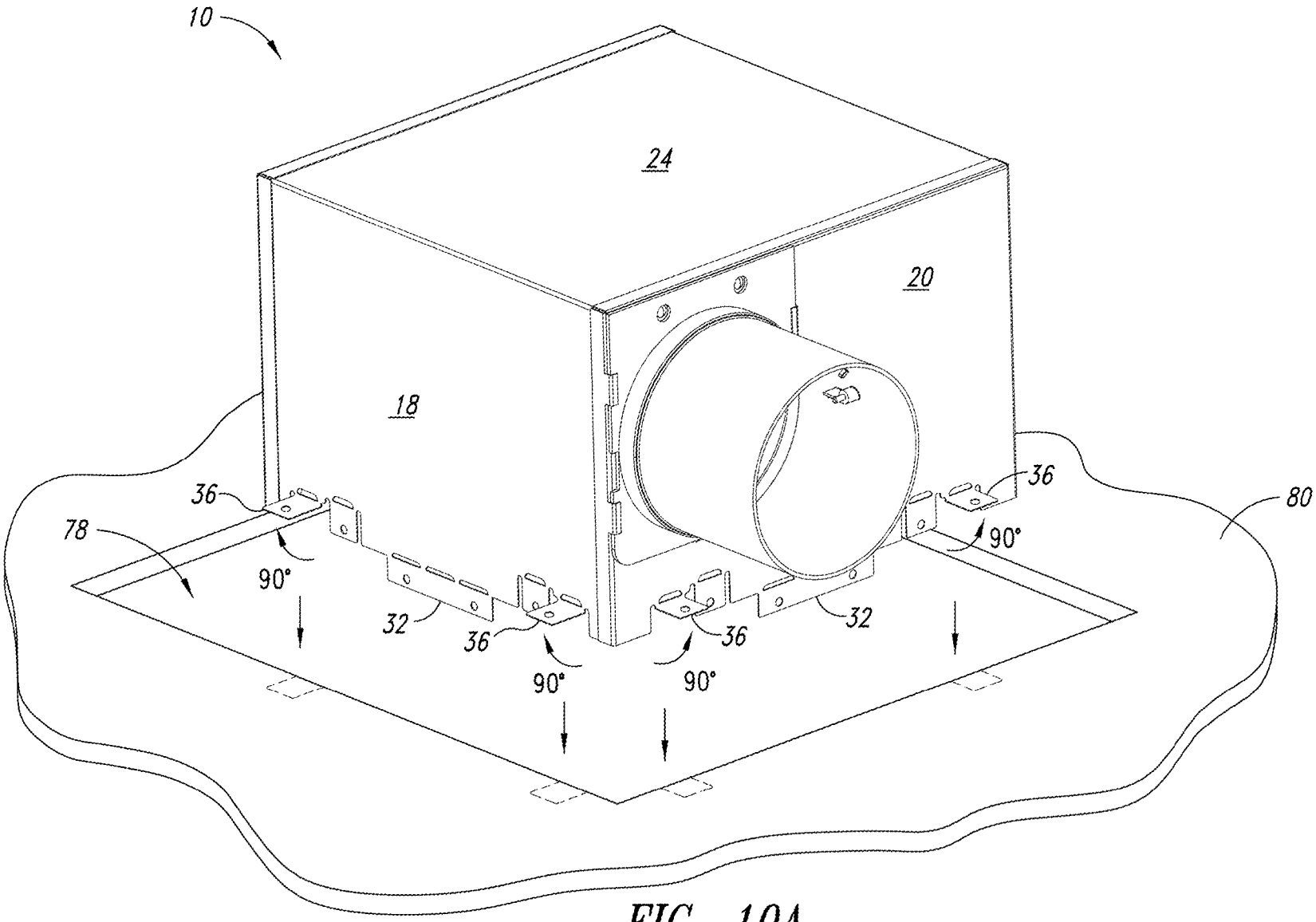
FIG. 10A is an illustration of the assembled housing and vent duct connector positioned above the rough opening with the outer tabs orthogonal to their respective walls.
Figure 10B:
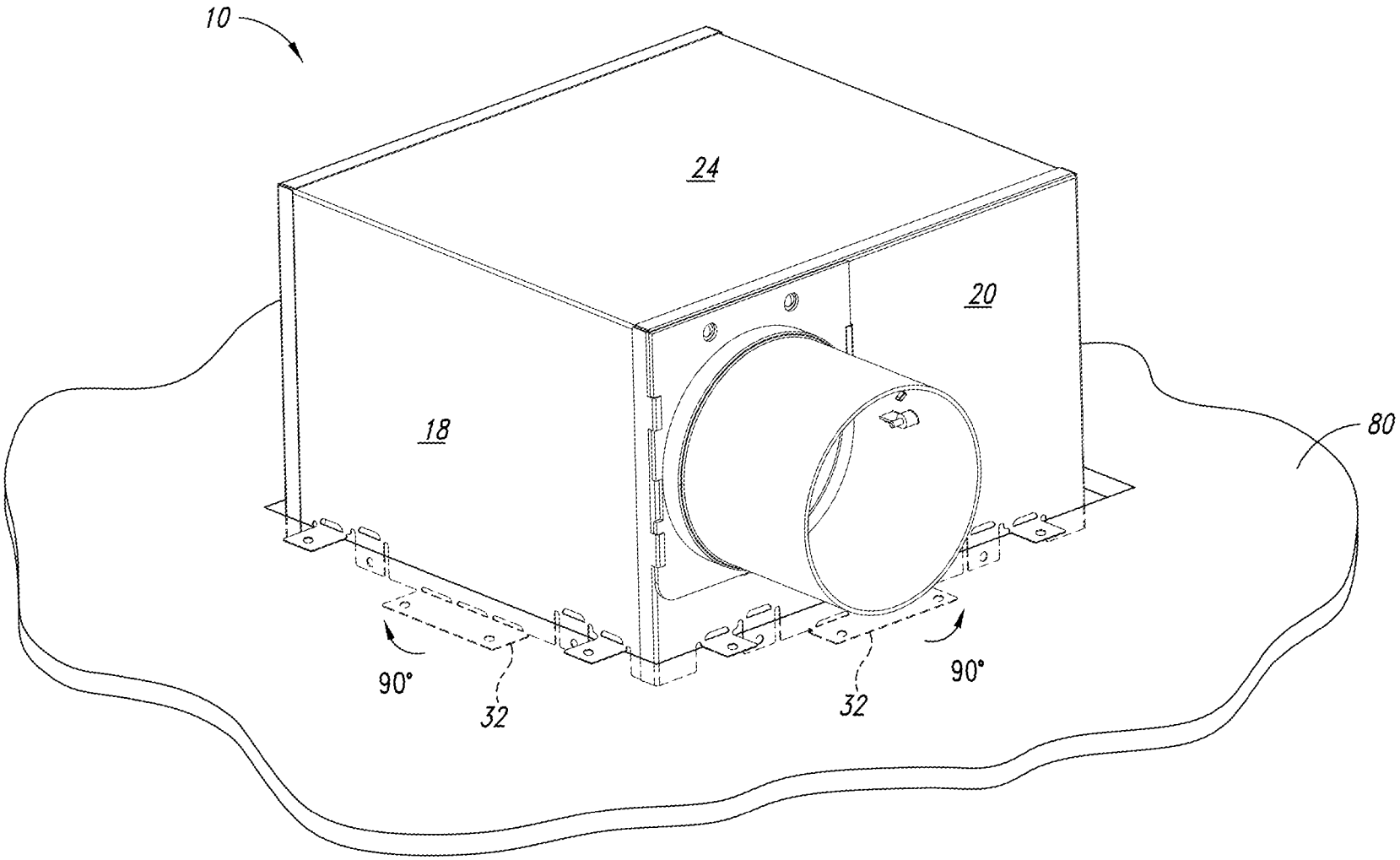
FIG. 10B is an illustration of the assembled housing and vent duct connector positioned in the rough opening and supported by the outer tabs on top of the structural member and held in place by the center tabs on an opposing side of the structural member.
Figure 11:
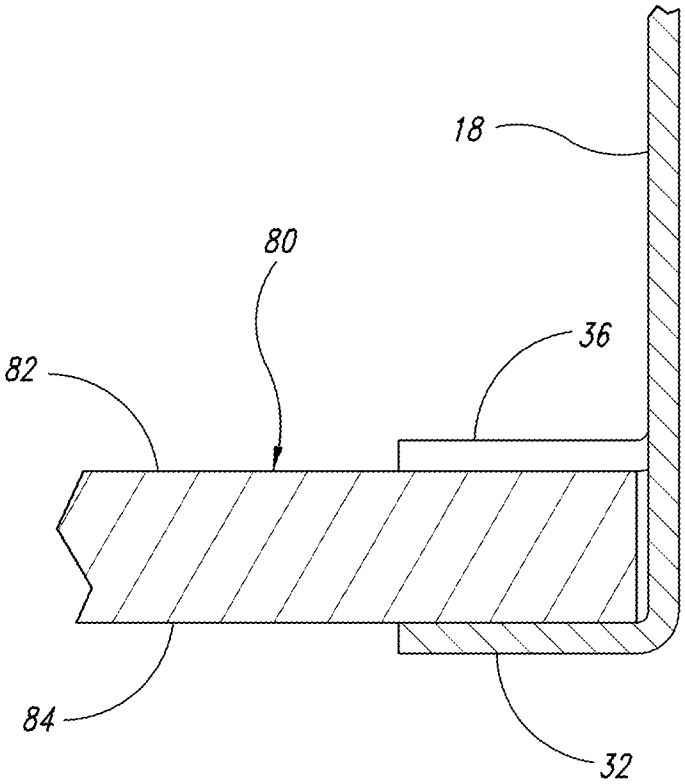
FIG. 11 is a partial cross-sectional side elevation showing the outer and center tabs holding the housing in place on the ceiling.

Referring to FIGS. 1-7, shown therein is a housing 10 formed of at least one wall 12 that defines an interior space 14. Ideally the fan housing 10 has the fan 100, motor 102, and electrical connection (not shown) in the housing interior 14 when it is sold or installed, although this is not required. The at least one wall 12 is formed as four side walls 16, 18, 20, 22 that are preferably but not required to be orthogonal to adjacent side walls, each side wall having a substantially square or rectangular planform shape. An end wall 24 is formed at a closed end 26 of the housing 10 while the opposing side is an open end 28. The cross-sectional configuration of the housing is that of a rectangle, and the shorter walls 16, 20 cooperate with the longer walls 18, 22 to form a rectangular planform shape. It is to be understood that the cross-sectional shape may vary from a circle to any number of sides (polygon), and other geometric shapes, such as triangle, square, and the three-dimensional housing shape may take other forms, such as a cone.

Each of the side walls 16, 18, 20, 22 has a distal end 30 on which is formed a plurality of tabs that include a center tab 32, a pair of intermediate tabs 34, one on each side of and adjacent to the center tab 32, and a pair of outside tabs 36, each outside tab 36 adjacent to a respective intermediate tab 34. Although referred to as tabs, it is to be understood that a tab can be a flange, flap, strip, or similar component. Each tab 32, 34, 36 has optional openings 38 for a fastener if desired, although the housing 10 is formed of material having a thickness that permits manual bending of the tabs about the supporting legs as described below in order to provide for mounting of the housing 10 to a structural member. The intermediate tabs 34 and outside tabs 36 extend even with the distal edge 44 of their respective wall 16, 18, 20, 22.

Ideally, each of the tabs 32, 24, 36 is co-planar with its respective wall 16, 18, 20, 22, when initially formed. However, the tabs 32, 24, 26 have a different bendable length and different bend lines to limit the length of the tab when it is repositioned. For example, center tab 32 has one or more elongate openings 40 formed at the intersection of the center tab 32 and the respective wall 16, 18, 20, 22. The size and shape of these openings 40 is a matter of design choice and aesthetic appearance. Between these openings 40 are legs 42 that support the tab 32 on the wall 16, 18, 20, 22 and that bend in response to a force exerted on the tab 32. Hence, the center tab 32 can be repositioned by bending about the legs 42 in a range of about 180 degrees either direction and, more preferably, to be orthogonal to the respective wall 16, 18, 20, 22, either towards the interior 14 or towards the exterior of the housing 10, which is described more fully below.

The center tab 32 extends further than the terminal end or distal edge 44 of the respective wall 16, 18, 20, 22 a sufficient distance that when the housing 10 is placed in the rough opening the center tab 32 extends down below the exterior surface of the structural member.

The intermediate tab 34 is formed by two longitudinal elongate openings 46, 48 on each side of the tab 34 of equal length. An elongate opening 40 is positioned below the intermediate tab 24 to form two support legs 42 that are sized and shaped to yield to a force asserted on the intermediate tab 34 and to bend up to and beyond a 90 degree angle, such as about 180 degrees either direction (limited by bend allowance). As such the tab 34 can be repositioned to any angle from 0 to about 180 degrees relative to the wall 22, including a preferred 90 degree or right angle. The length of the intermediate tab 42 when it is repositioned is determined by the distance of the respective opening 40 from the distal edge 44 of the respective wall 16, 18, 20, 22.

The outside tab 36 is formed by two longitudinal openings 50, 52 on either side and of equal length. The longitudinal opening 50 is longer than the adjacent longitudinal opening 48, and it joins the longitudinal opening 48 with a stepped bottom edge 54. The outside tab 36 is thus supported by two legs 42 as are the other tabs, and these two legs are separated by an elongate opening 40. The legs 42 bend adjacent the elongate opening 40 as do the legs of the other tabs 32, 24. However, the outside tab 36 is longer than the intermediate tab 34 due to the length of the longitudinal openings 50, 52, and this will form a larger tab 36 when force is applied to the tab 36 and the legs 42 bend in either direction. As with the center tab 32 and intermediate tab 34, the outside tab 36 can bend up to about 180 degrees (considering bend allowance) in either direction relative to the respective wall 16, 18, 20, 22. In this design, the outside tab 36 has a width of about ½ inch when it is bent about the legs 42 and the intermediate tab 34 has a width of about ⅝ inch when it is bent about its supporting legs 42.

As shown in the drawings, a duct opening 60 is formed in one of the walls, in this case the longer wall 20, and adjacent one edge of the wall 20. The opening can have a round or square shape, although almost any geometric or irregular shape may be used as needed. There are two L-shaped guides 62 on opposing sides of the vent duct opening 60, each L-shaped guide 62 has a foot 64 spaced away from the wall 20 to create a slot or track 66. A vent duct connector 68 is provided having a flange 70 that is sized and shaped to be slid into place in the slots or tracks 66 of the guides 62 after the ducting 72 is attached thereto. It is also possible to attach vent duct connector 68 to the housing 10 prior to attaching the ducting 72. The vent duct connector 68 has a cylindrical extension or tubular nozzle 74 (with a back draft swing damper—not shown). The tubular nozzle 74 is connected to the ducting 72 by sliding the ducting 72 in place over the nozzle 74, and a clamp may be used to secure the ducting in place, which is a conventional method of attaching ducting and will not be described in more detail herein.

A unique feature of the present design is the flange 70 material (preferably plastic) has two notches 76 on opposing sides that are sized and shaped to be slid over the L-shaped guides 62 so the vent duct connector 68 does not need to be raised up as high to get it started in the four tracks 66. This feature allows for a shallow opening installation.

Installation Process

A rough opening 78 is created in the structural member, here a ceiling 80, in which the fan and fan housing 10 in which the fan resides are to be mounted. The structural member can be a ceiling, a wall, a soffit, or other structural member of a residential or commercial building. Generally these structural members are formed from sheet rock or other interior wall or ceiling material that has a typical thickness of ½ inch or ⅝ inch. The rough opening 78 can be created for a new installation or it can be an existing rough opening in which an old fan is removed. In either situation, the rough opening 78 is prepped for the installation of the fan 100 and housing 10 of the present disclosure by sizing it to the correct dimensions of the housing 10.

After the rough opening 78 is prepared, the fan 100 and the housing 10 in which the fan resides are slid into the rough opening 78. The vent duct connector 68 is either already installed on the housing 10 as described above or it can be installed at this point by aligning the notches 76 with the upper L-shaped legs 62, then sliding the vent connector downward until it hits a stop 77 extending from the wall 20. The vent duct connector 68 can be installed before or after the housing 10 is placed through the rough opening 78. The vent duct connector 68 is then coupled to the ducting 72 by sliding the open end of the ducting over the nozzle portion 74 as described above.

The installer then repositions all the intermediate tabs 34 to about a 90 degree orientation with the respective wall 16, 18, 20, 22 when the structural member has a thickness of ⅝ inch. Alternatively, when the structural member has a thickness of about ½ inch, the installer will reposition the outside tabs 36 to an orientation of about 90 degrees with respect to the respective wall 16, 18, 20, 22. In either case, the tabs 34 or 36 are repositioned to face outwards away from the interior space 14 of the housing.

The housing 10 can now be placed over the rough opening 78 and will be supported on the top side or attic side 82 of the ceiling 80 by the respective intermediate tabs 34 or outside tabs 36. In this example the outside tabs 36 are used due to the thickness of the ceiling material 80. Next, the installer will reposition the center tabs 32 outward away from the interior 14 of the housing 10 to bear against the bottom side or room side 84 of the ceiling 80 to sandwich the ceiling 80 sheet rock between the center tabs 32 and the respective interior tabs 34 or outside tabs 36 as the case may be.

A key feature is this installation can always be done from the room side and without screws or attic access. In addition, this is particularly useful in situations where tools may not always be available. The tabs can be repositioned more than once, ideally 2, 3 or more times to facilitate removal and reinstallation as needed.

As will be readily appreciated from the foregoing, this design allows the installer to put the fan housing 10 up inside the rough opening and moved out of the way to work on the vent duct connection and the electrical connection. Preferably eight intermediate or outside tabs 34, 36 hold the housing 10 in the opening and the center tabs 32 are used to secure it to the sheet rock on the room side.

The electrical connections are located towards the room side so the connection can be done from the room side. Another unique feature is the sheet rock grab with the tabs. The notches on the vent duct connector enable the slide-in installation of the vent duct connector 68 and room side electrical to be a combined true "room side" installation or retrofit. New construction has access to studs and attic, so this design and method works well for new construction. This high level of ease on the room side has never been done before.

Another unique aspect of this design is the plastic has two notches so the installer does not need to raise the plastic up as high to get it started in the four metal tracks. This feature allows for a shallow opening installation.

The weight of the fan body and the pinching of the metal tabs is enough to overcome the low fan vibration.

It is to be appreciated that various aspects of the housing 10 and vent duct connector 68, taken alone and in combination, provide an aesthetic appearance that extends beyond any functionality associated therewith. Non-limiting examples include radius of curvature, symmetry and balance, use of geometric shapes not dictated by function, and the like.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A removable mounting housing that facilitates installation of an object in a rough opening in a structural member having a first surface and an opposing second surface, the housing comprising:

at least one wall that circumscribes an interior space, the interior space sized and shaped to accommodate retention of the object in the interior space, the at least one wall having a distal end and sized and shaped to extend into the rough opening;

a first tab extending from the distal end, the first tab sized and shaped to be bent to bear against the first surface of the structural member to prevent the housing from extending further into the rough opening; and a second tab bounded on only three of four sides by the at least one wall, the second tab sized and shaped to be bent to bear against the second surface of the structural member adjacent the rough opening and to support the housing on top of the structural member and to sandwich the structural member between the first tab and the second tab, wherein the first and second tabs are integrally formed with the at least one wall, and are co-planar with the at least one wall, the first and second tabs each having a first leg and a second leg that support the first and second tabs on the at least one wall, the first leg and second leg each being sized and shaped to yield to a force asserted on the respective first and second tabs to bend up to and beyond a 90 degree angle.

2. The removable mounting housing of claim 1 wherein the first and second legs on the first tab are formed by a transverse elongate opening at an intersection of the first tab and the distal end of the at least one wall, the transverse elongate opening being substantially collinear with the distal end of the at least one wall.

3. The removable mounting housing of claim 2 wherein the first and second legs of the second tab are formed by a transverse elongate opening and a longitudinal opening in the at least one wall, the transverse elongate opening being substantially parallel with the distal end of the at least one wall and the longitudinal elongate opening being substantially at a right angle to the transverse elongate opening, and wherein the first and second legs are formed of a material and of a thickness that facilitates manual bending of the respective first and second leg by hand and without requiring tools yet remaining in place under a load.

4. The removable mounting housing of claim 1 wherein the first tab extends from the distal end of the at least one wall and the second tab extends only to the distal end of the at least one wall.

5. A system that mounts in a rough opening formed in a structural member, the structural member having a first surface and an opposing second surface, the system comprising:

an object to be attached to the structural member;

a housing with at least one wall having a distal end that defines an interior space, the interior space sized and shaped to receive the object, the at least one wall sized and shaped to ne received within and extend into the rough opening the housing including:

a first tab extending from the distal end of the at least one wall, the first tab capable of being bent to bear against the first surface of the structural member and prevent the housing from extending further into the rough opening, the first tab including a first leg that supports the first tab on the distal end of the at least one wall; and a second tab bounded on only three of four sides by the at least one wall, the second tab capable of being bent to bear against the second surface of the structural member and cooperate with the first tab to sandwich the structural member between the first and second tabs and attach the housing to the structural member in the rough opening, the second tab including a first leg that supports the second tab in the at least one wall, wherein the first and second tabs are integrally formed with the at least one wall, are co-planar with the at least one wall, and the first legs of the first and second tabs are each configured to yield to a force asserted on the respective first and second tabs to bend up to and beyond a 90 degree angle.

6. The system of claim 5 wherein the first and second tabs are capable of being repeatedly bent without breaking.

7. The system of claim 6 wherein the first and second tabs are formed of a material and of a thickness that facilitates manual bending of the tabs by hand and without requiring tools yet remaining in place under load.

8. The system of claim 6 wherein the first leg of the first tab is formed by at least one opening at an intersection of the first tab and the distal end of the respective at least one wall.

9. The system of claim 8 wherein the at least one opening at the intersection of the first tab and the distal end of the respective at least one wall is an elongate transverse opening.

10. The system of claim 6 wherein the first leg of the second tab is formed by a first opening in the at least one wall and a second opening in the at least one wall.

11. The system of claim 10 wherein the first opening and the second opening that form the first leg of the second tab are elongate openings formed at substantially a right angle to each other.

12. The system of claim 6 wherein the first tab has a plurality of legs, each of the plurality of legs is formed by and positioned adjacent to at least one elongate opening in the at least one wall.

13. The system of claim 12 wherein the second tab has a plurality of legs, each of the plurality of legs is formed by a longitudinal elongate opening in the at least one wall and a transverse elongate opening in the at least one wall.

14. The system of claim 13 wherein the longitudinal elongate opening is substantially parallel to the distal end of the at least one wall and the transverse elongate opening is at substantially a right angle to the distal end of the at least one wall.

15. The system of claim 6 wherein the first tab is centrally located on the distal end of the at least first wall and the second tab is located adjacent the first tab on the at least first wall.

16. The system of claim 6 wherein the at least first wall comprises four walls that cooperate to form a rectilinear shape, each of the four walls having the first tab and the second tab formed thereon.

17. The system of claim 16 wherein each of the four walls comprises the first tab centrally located on the distal end of the respective wall and at least one second tab located adjacent each side of the first tab.

18. The system of claim 17 wherein each of the four walls comprises the first tab centrally located on the distal end of the respective wall and at least two second tabs located adjacent each side of the first tab.

* * * * *